US008162430B2

(12) United States Patent
Kachi

(10) Patent No.: US 8,162,430 B2
(45) **Date of Patent: *Apr. 24, 2012**

(54) IMAGE FORMING APPARATUS

(75) Inventor: Yasuhiko Kachi, Kanagawa (JP)

(73) Assignee: FujiFilm Corporation, Tokyo (JP)

( * ) Notice: Subject to any disclaimer, the term of this patent is extended or adjusted under 35 U.S.C. 154(b) by 345 days.

This patent is subject to a terminal disclaimer.

(21) Appl. No.: 12/585,931

(22) Filed: Sep. 29, 2009

(65) Prior Publication Data

US 2010/0079531 A1 Apr. 1, 2010

(30) Foreign Application Priority Data

Sep. 30, 2008 (JP) ..... 2008-255371

(51) Int. Cl.
*B41J 29/38* (2006.01)
*B41J 2/01* (2006.01)

(52) U.S. Cl. ..... 347/16; 347/104
(58) Field of Classification Search ..... 347/16, 347/101, 102, 104
See application file for complete search history.

(56) References Cited

U.S. PATENT DOCUMENTS 7,172,263 B2 * 2/2007 Takatsuka et al. ..... 347/32
7,510,276 B2 * 3/2009 Kruijt ..... 347/101

FOREIGN PATENT DOCUMENTS

JP 2006-232500 A 9/2006

* cited by examiner

*Primary Examiner* — An Do
(74) *Attorney, Agent, or Firm* — Jean C. Edwards, Esq.; Edwards Neils PLLC

(57) ABSTRACT

An image forming apparatus including a formation unit that forms an image on a first surface of a recording medium; a suction conveyance unit that conveys the recording medium to the formation unit while suctioning the recording medium onto a guide surface; a switchback conveyance unit that inverts the recording medium on whose first surface an image has been formed to allow a second surface of the recording medium to be used as an image formation surface, and conveys the recording medium to the suction conveyance unit; and a conditioning unit that conditions the first surface of the recording medium, wherein the conditioning unit controls a rate of moisture absorption of a surface of the recording medium and causes the recording medium that is fed to the suction conveyance unit via the switchback conveyance unit to bend such that the center portion thereof separates from the guide surface.

5 Claims, 9 Drawing Sheets

IMAGE FORMING APPARATUS

CROSS-REFERENCE TO RELATED APPLICATION

This application claims priority under 35 USC 119 from Japanese Patent Application No. 2008-255371 filed on Sep. 30, 2008, the disclosure of which is incorporated by reference herein.

BACKGROUND OF THE INVENTION

1. Technical Field

The present invention relates to an image forming apparatus that is suited for forming an image on a recording medium particularly with an inkjet recording head.

2. Related Art

Image forming apparatus that form an image on a recording medium such as recording paper with an inkjet recording head are widely known. These image forming apparatus convey the recording medium directly under the recording head and form an image on the recording medium.

In such image forming apparatus, image formation ends up being distorted when the distance between the head plane and the recording medium is uneven. In a worst-case scenario, it is conceivable for the recording head and the recording medium to come into contact with each other such that the recording head sustains damage or the recording medium becomes jammed. For this reason, correcting the shape of the recording medium has, as described in Japanese Patent Application Laid-Open Publication (JP-A) No. 2006-232500, for example, conventionally been performed.

Here, in recent years, image forming apparatus disposed with a switchback conveyance path so that the image forming apparatus can form an image on both sides of the recording medium have been developed. For example, the image forming apparatus described in Japanese Patent Application Laid-Open Publication (JP-A) No. 2006-232500 inverts a recording medium on a switchback conveyance path and conveys the recording medium directly under a recording head.

When an image forming apparatus forms an image on both sides of the recording medium in this manner, immediately after the recording head has formed an image on one surface (front surface) of the recording medium, a rate of moisture absorption of this surface increases in comparison to the opposite surface (back surface), and the one surface (front surface) separates from a surface of to a conveyance path so as to rise from the conveyance path. As a result, when the recording medium is further conveyed under the recording head after the recording medium has been reversed to invert its front and back sides in order to form an image on the back surface thereof; the surface side on which an image was formed and that was separating from the surface of the conveyance path becomes the side that contacts the conveyance path, and the recording medium is conveyed. When the recording medium is held by suction onto a conveyance guide in this state, both leading and trailing edge portions of the recording medium cannot be sufficiently held by suction, and image formation is performed in a state in which both edge portions of the recording medium are separated from the conveyance guide. Consequently, the distance between the head plane and the recording medium becomes uneven, which affects image quality, for example by disrupting image formation. In the worst case, the head and the paper edges may come into contact with each other and lead to ink leakage or head failure.

As a countermeasure, in JP-A No. 2006-232500, there is disclosed forming an image on one surface of recording paper, thereafter controlling deformation of the recording paper before causing the recording paper to switch back, and preventing rising of the leading edge of the recording paper.

SUMMARY

It is more preferable for an image forming apparatus to be able to convey the recording paper on the conveyance path more effectively when, after the image forming apparatus has formed an image on one surface of the recording paper, the image forming apparatus inverts the recording paper to form an image on the other surface of the recording paper.

In consideration of these circumstances, the present invention provides an image forming apparatus that can effectively convey a recording medium along a conveyance path even when the image forming apparatus inverts the recording medium.

An image forming apparatus of a first aspect is an image forming apparatus including: a formation unit that forms an image on a first surface of a recording medium by inkjetting; a suction conveyance unit that conveys the recording medium to the formation unit while suctioning the recording medium onto a guide surface which is a conveyance path; a switchback conveyance unit that inverts the recording medium on whose first surface an image has been formed by the formation unit to allow a second surface of the recording medium to be used as an image formation surface, and conveys the recording medium to the suction conveyance unit; and a conditioning unit that conditions the first surface of the recording medium, wherein the conditioning unit controls a rate of moisture absorption of a surface of the recording medium and causes the recording medium that is fed to the suction conveyance unit via the switchback conveyance unit to bend such that the center portion of the recording medium separates from the guide surface of the suction conveyance unit.

A state where the recording medium is bent such that its center portion separates from the guide surface of the suction conveyance unit is a state where the recording medium is bent such that its conveyance direction leading edge comes nearer to the suction conveyance unit (the conveyance path) in comparison to its conveyance direction center portion.

In the image forming apparatus of the first aspect, the front and back sides of the recording medium on whose first surface an image has been formed by the formation unit are inverted by the switchback conveyance unit. Conditioning of the recording medium by the conditioning unit while the recording medium is being conveyed by the switchback conveyance unit contributes to the recording medium being fed to the conveyance path in a state where the recording medium is bent such that its center portion separates from the guide surface of the suction conveyance unit. Additionally, the suction conveyance unit conveys the recording medium while adhering the recording medium by suction onto the conveyance path. Consequently, even when the recording medium is fed in a state where the recording medium is bent such that its center portion separates from the guide surface of the suction conveyance unit, the recording medium is given a shape following the shape of the conveyance path and is conveyed, and the leading edge of the recording medium does not rise from the conveyance path as in a case in which the recording medium bends such that its center portion becomes concave toward the conveyance path (the guide surface).

In this manner, the image forming apparatus of the first aspect can effectively convey the recording medium along the conveyance path even when the image forming apparatus inverts the recording medium.

An image forming apparatus of a second aspect of the invention is the image forming apparatus of the first aspect, further comprising a blowing unit that blows air onto and dries a surface of the recording medium on which an image has been formed by the formation unit, wherein the conditioning unit conditions the first surface of the recording medium by directing the air that is blown from the blowing unit onto the first surface of the recording medium while the recording medium is being conveyed by the switchback conveyance unit.

The image forming apparatus of the second aspect conditions the recording medium utilizing the air that is blown from the blowing unit so as to dry the surface of the recording medium on which an image has been formed by the formation unit. Consequently, the conditioning unit can be given a simple configuration.

An image forming apparatus of a third aspect of the invention is the image forming apparatus of the first aspect, wherein a suction part is disposed in the suction conveyance unit. The suction part performs negative pressure suction from an underside of the conveyance path so as to adhere the recording medium by suction onto the conveyance path, and the conditioning unit conditions the first surface of the recording medium by directing air that has been expelled from the suction unit onto the first surface of the recording medium while the recording medium is being conveyed by the switchback conveyance unit.

The image forming apparatus of the third aspect conditions the recording medium utilizing the air that has been sucked in order to adhere the recording medium onto the conveyance path. Consequently, the conditioning unit can be given a simple configuration, and an energy-saving effect is obtained.

An image forming apparatus of a fourth aspect of the invention is the image forming apparatus of the third aspect, further comprising a blowing unit that blows air onto and dries a surface of the recording medium on which an image has been formed by the formation unit, wherein the conditioning unit causes the air that is blown from the blowing unit to mix with the air that is expelled from the suction unit and blown onto the first surface of the recording medium while the recording medium is being conveyed by the switchback conveyance unit. Thus, the image forming apparatus can condition the recording medium efficiently in a shorter amount of time.

An image forming apparatus of a fifth aspect of the invention is the image forming apparatus of the third aspect, further comprising a sub-scanning roller that conveys the recording medium from the switchback conveyance unit to the conveyance path. The sub-scanning roller includes a roller surface that contacts the first surface of the recording medium.

In the image forming apparatus of the fifth aspect, the recording medium can be bent by the sub-scanning roller along with the conditioning unit, and the recording medium is fed in a state where the recording medium is bent such that its center portion separates from the surface of the conveyance path.

According to the present invention, there can be provided an image forming apparatus that can effectively convey a recording medium along a conveyance path even when the image forming apparatus inverts the recording medium.

BRIEF DESCRIPTION OF THE DRAWINGS

Exemplary embodiments of the present invention will be described in detail based on the following figures, wherein.

DETAILED DESCRIPTION OF THE INVENTION

Figure 1:
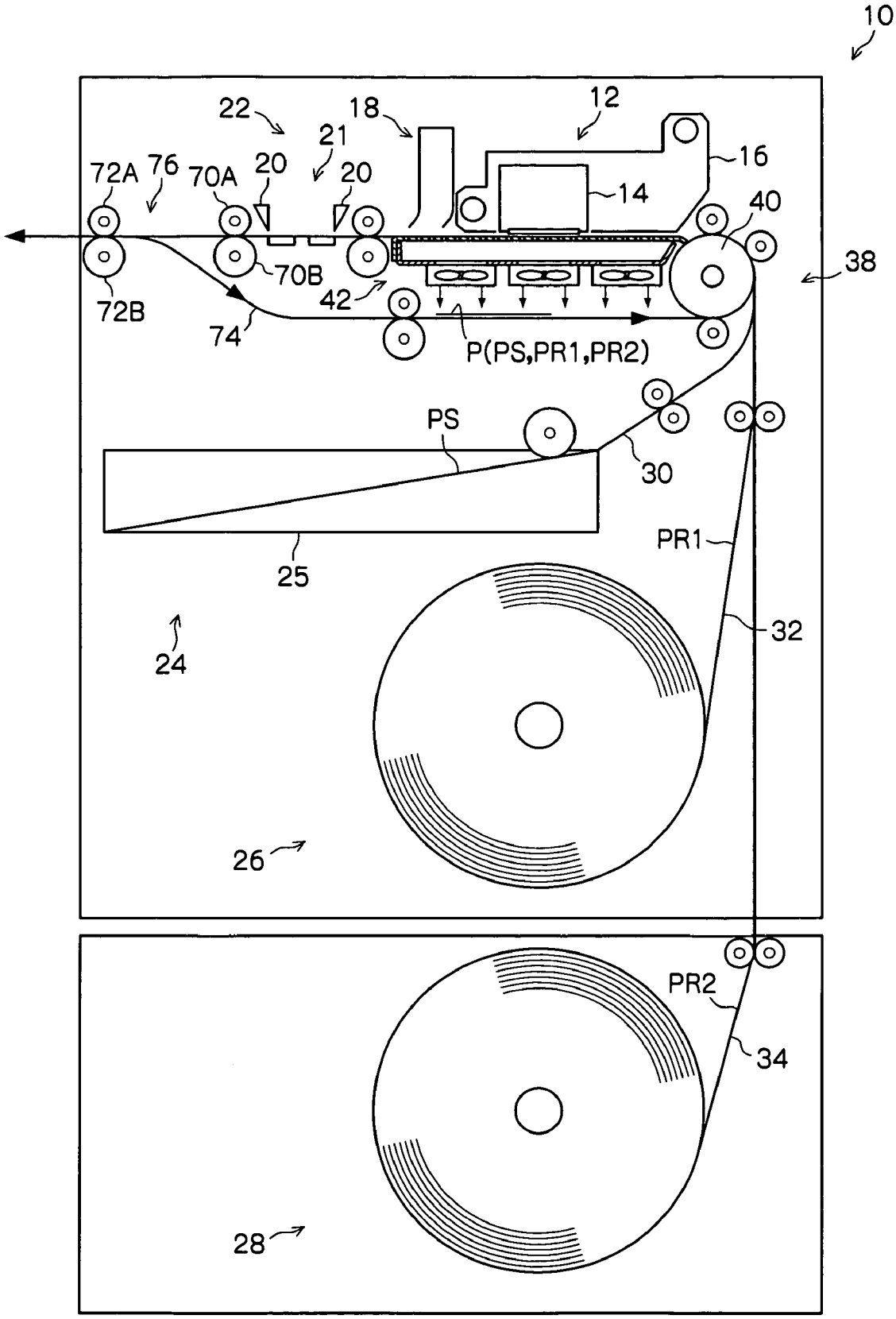
FIG. 1 is a side view showing the configuration of an image forming apparatus pertaining to a first exemplary embodiment.

Below, exemplary embodiments of the present invention will be described. From the second exemplary embodiment on, identical reference numerals will be given to components that are same as components that have already been described, and description of those identical components will be omitted.

First Exemplary Embodiment

Figure 2:
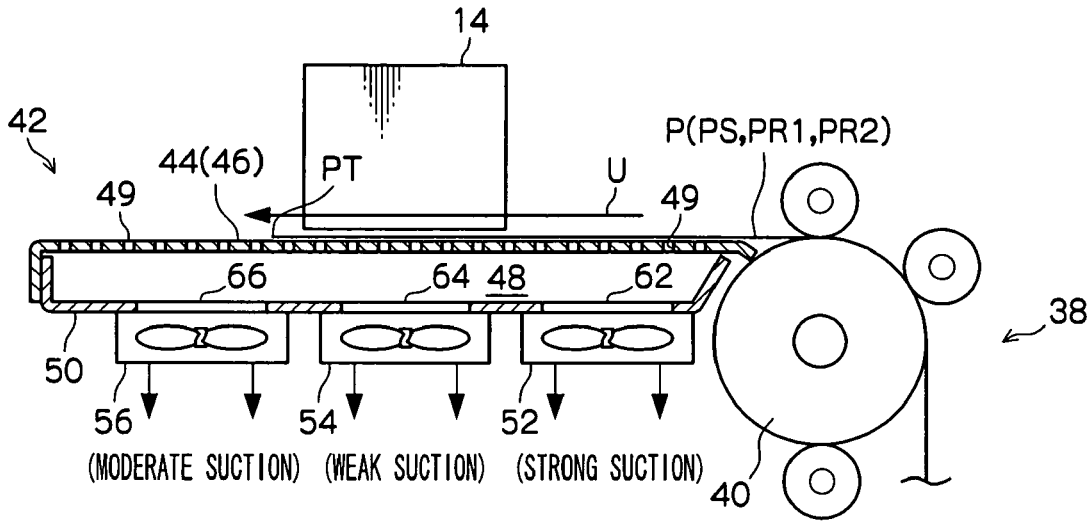
FIG. 2 is a side sectional view showing recording paper being adhered by suction and conveyed in the image forming apparatus pertaining to the first exemplary embodiment.

A first exemplary embodiment will be described. As shown in FIG. 1 and FIG. 2, an image forming apparatus 10 pertaining to the present exemplary embodiment is equipped with a formation unit 12 that forms an image on recording paper. The formation unit 12 includes an inkjet recording head 14 that ejects ink droplets onto the recording paper and a carriage 16 that holds the inkjet recording head 14. In the present exemplary embodiment, the image forming apparatus 10 is a color image forming apparatus that forms an image with the four colors of yellow (Y), magenta (M), cyan (C) and black (K), but the present exemplary embodiment is also applicable to a black-and-white image forming apparatus.

Further, the image forming apparatus 10 is equipped with a dryer 18 that supplies dry air to a recording surface side of the paper on which an image has been formed by the inkjet recording head 14 to solidify the ink droplets, a cutter 20 that cuts the recording paper and a main conveyance unit 22 that sequentially conveys the recording paper to the inkjet recording head 14, the dryer 18 and the cutter 20. The dryer 18 comprises a fan that blows air and a heater that is disposed on an upstream side or a downstream side of the fan. In FIG. 1, the cutter 20 is shown as having two blades, but the number of blades may also be one.

Further, the image forming apparatus 10 is equipped with a sheet paper supply unit 24 that supplies sheet recording paper and a first roll paper supply unit 26 and a second roll paper supply unit 28 that supply elongate recording paper. The sheet paper supply unit 24 is equipped with a paper supply cassette 25 that houses the recording paper such that the top surface side of the recording paper becomes a later-described side that is open to the atmosphere. Additionally, the recording paper that has been fed from any of the sheet paper supply unit 24, the first roll paper supply unit 26 and the second roll paper supply unit 28 is inverted by a later-described sub-scanning roller 40 and is fed to the main conveyance unit 22.

(Conveyance Mechanism)

A conveyance mechanism of the image forming apparatus 10 will be described in detail including the main conveyance unit 22.

The image forming apparatus 10 is equipped with a sheet conveyance unit 30 that conveys sheet recording paper PS that has been fed from the sheet paper supply unit 24, a first roll conveyance unit 32 that conveys elongate recording paper PR1 that has been fed from the first roll paper supply unit 26 and a second roll conveyance unit 34 that conveys elongate recording paper PR2 that has been fed from the second roll paper supply unit 28 (hereinafter, for convenience of explanation, the recording paper PS, the recording paper PR1 and the recording paper PR2 will sometimes be described generically as "the recording paper P").

The recording paper P is, for example, paper for photo prints or plain paper. A coating layer including water-absorbing silica particles is formed on both sides of paper for photo prints. Consequently, when drying proceeds on one side of the recording paper P, the coating layer on the one side shrinks, and the one side bends such that its center portion becomes concave. Further, in the case of plain paper also, similarly, when one side contacts the atmosphere, drying of this one side proceeds, shrinkage of the paper fiber proceeds, and this one side bends such that its center portion becomes concave. Further, paper that has a coating layer including water-absorbing silica particles on both sides for photo books proposed in recent years also has the same characteristic.

Further, the image forming apparatus 10 is equipped with a decurling conveyance unit 38 that feeds the recording paper P from the sheet paper supply unit 24, the first roll paper supply unit 26 and the second roll paper supply unit 28 to the main conveyance unit 22 and decurls the recording paper P from a later-described switchback conveyance path 74. The decurling conveyance unit 38 also slightly decurls the recording paper PS that has been fed from the sheet paper supply unit 24.

The decurling conveyance unit 38 is equipped with the sub-scanning roller 40 that feeds the recording paper P that has been conveyed from any of the sheet conveyance unit 30, the first roll conveyance unit 32 and the second roll conveyance unit 34 to the main conveyance unit 22.

When the sub-scanning roller 40 conveys the recording paper PS that has been fed from the sheet paper supply unit 24, the top surface side of the recording paper PS in a state where it is housed in the sheet paper supply unit 24 becomes the surface that is wrapped around the sub-scanning roller 40 (that is, the surface that contacts the roller outer peripheral surface), and the recording paper PS is wrapped around the sub-scanning roller 40 such that its image formation surface does not contact the roller outer peripheral surface. Further, when the sub-scanning roller 40 conveys the recording paper PR1 that has been fed from the first roll paper supply unit 26 or the recording paper PR2 that has been fed from the second roll paper supply unit 28, the inner peripheral surface side of the recording paper in a state where it is wound in the roll paper supply units 26 and 28 becomes the surface that is wrapped around the sub-scanning roller 40.

A suction conveyance unit 42 is disposed in the main conveyance unit 22. The suction conveyance unit 42 is configured to adhere by suction and convey the recording paper P that has been conveyed from the sub-scanning roller 40 to a region where an image is formed on the recording paper P by the formation unit 12 (that is, immediately under the inkjet recording head 14) and to further adhere by suction and convey the recording paper P to a region where the dry air from the dryer 18 is blown on the recording paper P. Further, the main conveyance unit 22 is equipped with a cutter conveyance unit 21 that conveys the recording paper P that is conveyed from the suction conveyance unit 42 to a region where the recording paper P is cut by the cutter 20.

The suction conveyance unit 42 is equipped with a conveyance path forming member 46 that forms a conveyance path 44 on its top side and a concave air chamber forming member 50 that forms an air chamber 48 between itself and the conveyance path forming member 46 on the bottom side of the conveyance path 44. Numerous open portions 49 for allowing the air chamber 48 and the conveyance path 44 to be communicated with each other are disposed in the conveyance path forming member 46.

Moreover, the suction conveyance unit 42 is equipped with three suction fans 52, 54 and 56 sequentially along a conveyance direction U of the suction conveyance unit 42 below the air chamber forming member 50. Additionally, openings 62, 64 and 66 are respectively formed in the bottom side of the air chamber forming member 50 such that the suction fans 52, 54 and 56 are communicated with the air chamber 48, and the recording paper P is conveyed while being adhered by suction onto the conveyance path 44 by negative pressure suction resulting from the suction fans 52, 54 and 56.

In the present exemplary embodiment, the suction force of the suction fan 52 at the entrance side of the conveyance path 44 (the suction fan provided closest to the sub-scanning roller 40) is strong, the suction force of the suction fan 54 that applies suction to the side directly under the inkjet recording head 14 is weak, and the suction force of the suction fan 56 at the exit side of the conveyance path 44 (the suction fan provided closest to the dryer 18) is moderate. Accordingly, a distribution of suction force due to the suction fans 52, 54 and 56 is formed along the conveyance direction U of the conveyance path 44, and the recording paper P is held by suction onto the conveyance path 44 due to this distribution of suction force.

Further, the image forming apparatus 10 includes, under the suction conveyance unit 42 and the cutter conveyance unit 21, a switchback conveyance path 74 that is parallel to the suction conveyance unit 42 and the cutter conveyance unit 21. The switchback conveyance path 74 branches from a branching portion 76 formed between a pair of conveyance rollers 70A and 70B and a pair of conveyance rollers 72A and 72B. The pair of conveyance rollers 70A and 70B are disposed directly on the downstream side of the cutter conveyance unit 21 and the pair of conveyance rollers 72A and 72B are disposed on the downstream side of the pair of conveyance rollers 70A and 70B. The switchback conveyance path 74 leads to the decurling conveyance unit 38. Additionally, air that has been expelled from the suction fans 52, 54 and 56 is blown onto the top surface side of the recording paper P while the recording paper P is being conveyed on the switchback conveyance path 74.

Below, the action and effects of the present exemplary embodiment will be described.

The recording paper PS that has been fed from the paper supply cassette 25 to the decurling conveyance unit 38, intermittently conveyed from the sub-scanning roller 40 and fed to the suction conveyance unit 42 is slightly decurled by the decurling conveyance unit 38, bends such that a center portion of the recording paper PS slightly separates from the surface of the conveyance path 44 (i.e., a guide surface of the suction conveyance unit 42), and is fed onto the conveyance path 44.

Figure 3:
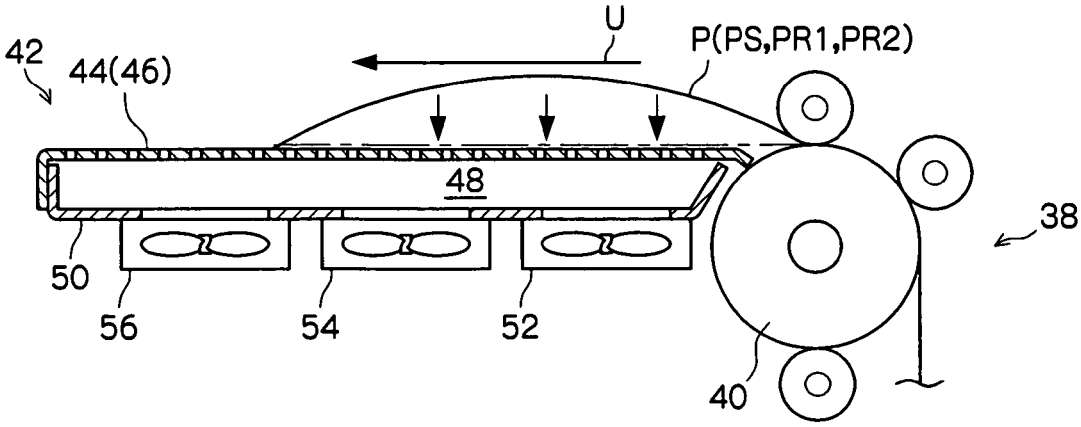
FIG. 3 is a side sectional view describing the recording paper being conveyed while prevented from rising from a conveyance path in the image forming apparatus pertaining to the first exemplary embodiment.

Then, the recording paper PS is conveyed while being held by suction on the conveyance path 44, beginning with its leading edge PT, by the strong suction force resulting from the suction fan 52. Here, as shown in FIG. 3, when the suction force is not acting on the recording paper P (PS, PR1, PR2), the recording paper P bends such that its center portion slightly separates from the surface of the conveyance path 44; however, when the suction force acts on the recording paper PS, as shown in FIG. 2, the recording paper PS flattens out according to the shape of the conveyance path, and is conveyed. Consequently, the leading edge PT of the recording paper PS does not rise from the conveyance path 44. When the recording paper PS bends such that its center portion becomes concave toward the surface of the conveyance path 44 and its leading edge PT separates from the conveyance path 44, a large suction force is needed to adhere the leading edge of the recording paper onto the conveyance path. However, this disadvantage can be avoided in the present exemplary embodiment.

Further, because the recording paper PS bends so as to slightly separate from the surface of the conveyance path 44, the trailing edge of the recording paper PS also does not rise from the conveyance path 44. Additionally, because the recording paper PS bends in this manner, the leading edge PT and the trailing edge of the recording paper PS do not rise from the conveyance path 44 even though the suction force of the suction fan 54 immediately under the inkjet recording head 14 is weak.

The recording paper PS is conveyed on the conveyance path 44 in this manner, and an image is formed on the top surface side (first surface) of the recording paper PS by the ink ejection droplets from the inkjet recording head 14 in the formation unit 12. Then, a solvent included in the ink ejection droplets is absorbed by the coating layer of the recording paper PS or the fibers of the paper, and the top surface side of the recording paper PS absorbs more moisture than the bottom surface side and expands. For this reason, a force that causes the recording paper PS to become even more convex toward the top surface side (upside) acts on the top surface side of the recording paper PS.

Then, warm air from the dryer 18 is applied to the recording paper PS, and it is sequentially passed through the cutter conveyance unit 21 and the branching portion 76. When an image is formed only on one side of the recording paper PS, it is conveyed from the pair of conveyance rollers 72A and 72B. When an image is formed on both sides of the recording paper PS, the conveyance direction is reversed such that the recording paper PS is conveyed on the switchback conveyance path 74. Then, while the recording paper PS is being conveyed on the switchback conveyance path 74, the air that has been expelled from the suction fans 52, 54 and 56 is applied to the top surface side of the recording paper P. As a result of the operation of the dryer 18 and the like in the image forming apparatus 10, the air temperature inside the apparatus rises, and the humidity of the air inside the apparatus drops in comparison to that of the atmosphere. Consequently, the rate of moisture absorption of the top surface side of the recording paper PS decreases, and the temperature of the top surface side of the recording paper PS rises.

The recording paper PS is further conveyed from the switchback conveyance path 74 to the decurling conveyance unit 38 and is decurled. In this manner, the rate of moisture absorption of the top surface side of the recording paper PS drops and the temperature of the top surface side of the recording paper PS rises on the switchback conveyance path 74, and the bending direction of the recording paper PS which has been decurled by the decurling conveyance unit 38 is reversed. That is, when the recording paper PS exits the decurling conveyance unit 38, the recording paper PS bends such that its center portion separates from the surface of the conveyance path. Consequently, when the recording paper PS is conveyed on the conveyance path 44 for the second image formation (image formation on the opposite surface side), similar to the first image formation, the recording paper PS is conveyed while being made to conform to the shape of the conveyance path by the suction force due to the suction fan 52 and the like, and the leading edge of the recording paper PS does not rise from the conveyance path 44 as it tends to do when the recording paper PS bends such that its center portion becomes concave toward the surface of the conveyance path 44.

While the recording paper PS is conveyed in this manner on the conveyance path 44, an image is formed on the top surface side of the recording paper PS with the inkjet recording head 14. Then, the recording paper PS is dried by warm air from the dryer 18 and is sequentially conveyed through the cutter conveyance unit 21, the pair of conveyance rollers 70A and 70B, the branching portion 76 and the pair of conveyance rollers 72A and 72B.

As described above, in the present exemplary embodiment, both when the image forming apparatus 10 forms an image on one side of the recording paper PS and forms images on both sides of the recording paper PS using the switchback conveyance path 74, the recording paper PS is given a shape following the shape of the conveyance path 44 and is conveyed, and the leading edge of the recording paper PS does not rise from the conveyance path 44 in contrast with a case that the recording paper bends such that its center portion becomes concave toward the surface of the conveyance path 44.

Further, the suction fan 54 that sucks with the weakest suction force of the three suction fans 52, 54 and 56 is disposed directly under the inkjet recording head 14. Consequently, a strong airflow that may not allow the ink droplets to land in their intended positions can be prevented from being generated under the inkjet recording head 14. This is particularly effective when forming an image as far as the leading edge of the recording paper PS (e.g., when forming an image in a marginless photo print).

Further, the recording paper PR1 that has been supplied from the first roll paper supply unit 26 and the recording paper PR2, supplied from the second roll paper supply unit 28 are wound in rolls before being supplied therefore, their bending direction is already determined when they have been fed. That is, the recording paper PR1 and the recording paper PR2 that have been supplied to the conveyance path 44 bend beforehand so as to separate from the surface of the conveyance path 44. Thus, the recording paper PR1 and the recording paper PR2 can be equally or more excellently conveyed on the conveyance path 44 as compared with the case when the images are formed on both sides of the sheet recording paper PS, and an excellent image can be formed on both sides of the recording paper PR1 and the recording paper PR2.

In the present exemplary embodiment, conditioning of the recording paper P is performed as follows: The rate of moisture absorption of the top surface side of the recording paper P is lowered and the temperature thereof is raised by applying the air that has been expelled from the suction fans 52, 54 and 56 to the top surface side of the recording paper P while the recording paper P is conveyed on the switchback conveyance path 74. However, the warm air that has been blown from the dryer 18 toward the recording paper P immediately after the recording paper P has exited the formation unit 12 may also be introduced to the air that has been expelled from the suction fans 52, 54 and 56. Thus, the temperature of the top surface side of the recording paper P that is being conveyed on the switchback conveyance path 74 is further raised, drying of the top surface side of the recording paper P is enhanced, and it becomes easier for the recording paper P to further deform into a concave shape. Accordingly, it becomes even easier that, after passing through the decurling conveyance unit 38, the center portion of the recording paper P separates from the surface of the conveyance path 44 of the suction conveyance unit 42. Consequently, the decurling capability of the decurling conveyance unit 38 does not have to be relatively high, and it is also possible to dispose, instead of the decurling conveyance unit 38, a mechanism that simply conveys the recording paper P to the conveyance path 44 without a decurling function.

Second Exemplary Embodiment

Figure 4:
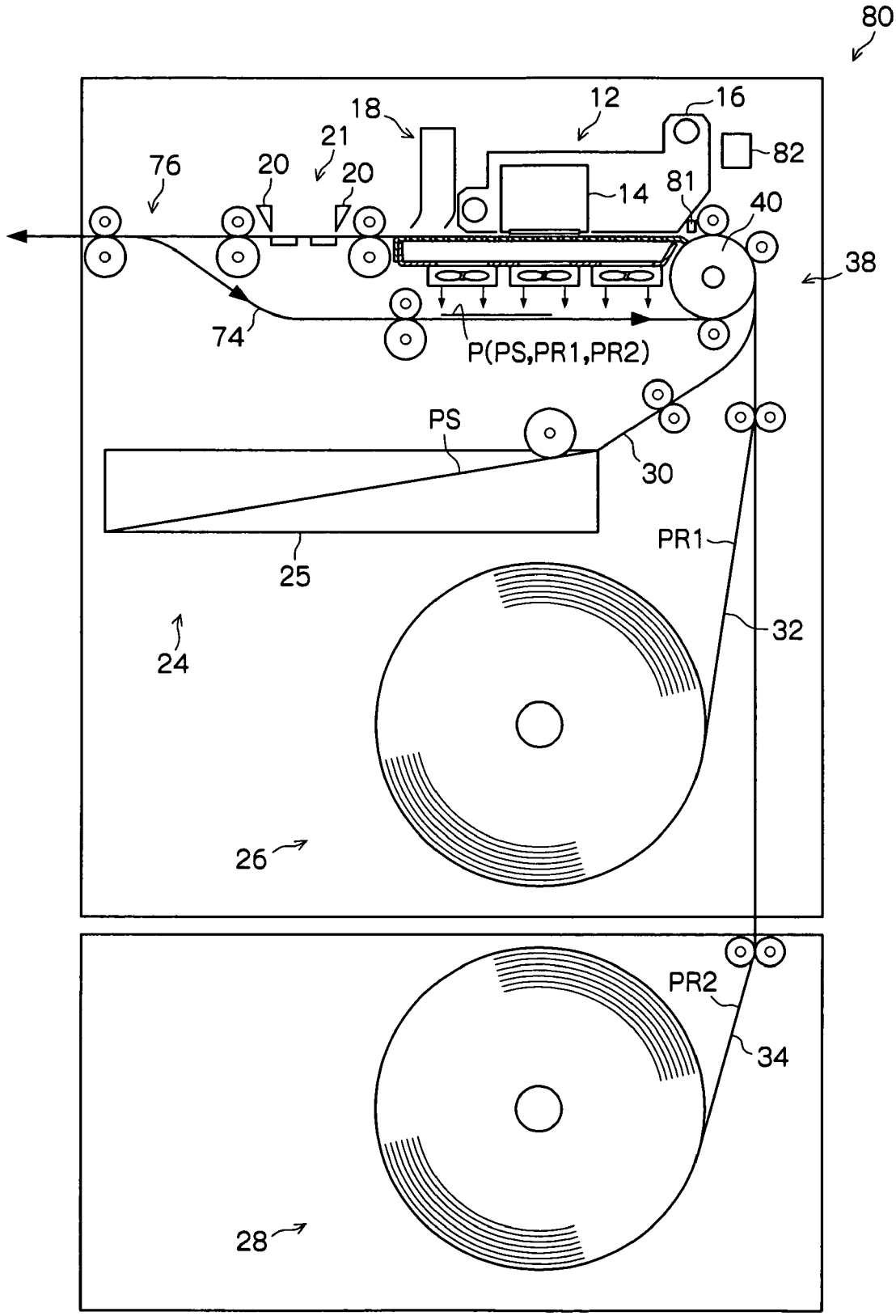
FIG. 4 is a side sectional view showing the configuration of an image forming apparatus pertaining to a second exemplary embodiment.

Next, a second exemplary embodiment will be described. As shown in FIG. 4, an image forming apparatus 80 pertaining to the present exemplary embodiment has the same configuration as that of the image forming apparatus 10 pertaining to the first exemplary embodiment and is further equipped with a sensor 81 that detects the position of the conveyance direction leading edge of the recording paper P on the conveyance path 44 and a control unit 82 that controls the suction force of each of the suction fans 52, 54 and 56 on the basis of a signal received from the sensor 81. According to this configuration, the distribution of suction force along the conveyance direction U resulting from the suction fans 52, 54 and 56 is controlled by the control unit 82, and the distribution of suction force with which the recording paper P is adhered by suction onto the conveyance path 44 along the conveyance direction U is controlled by the control unit 82.

According to the present exemplary embodiment, the distribution of the suction force can be adjusted in response to the conveyance position of the recording paper P, and the effect of conveying the recording paper P without allowing the leading edge of the recording paper P to rise can be exhibited even more excellently.

Third Exemplary Embodiment

Figure 5A:
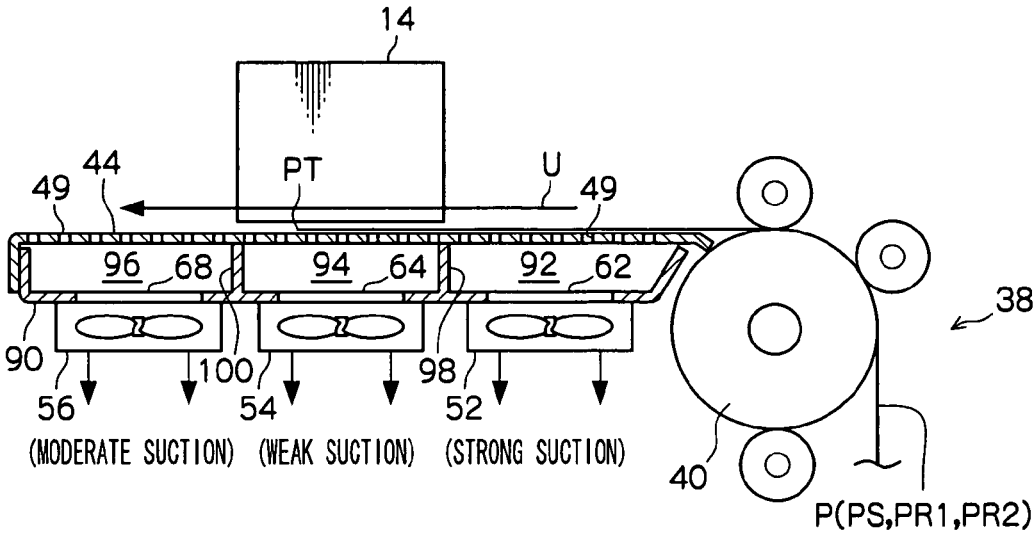
FIG. 5A and FIG. 5B are side sectional views showing the recording paper being adhered by suction and conveyed in an image forming apparatus pertaining to a third exemplary embodiment.
Figure 5B:
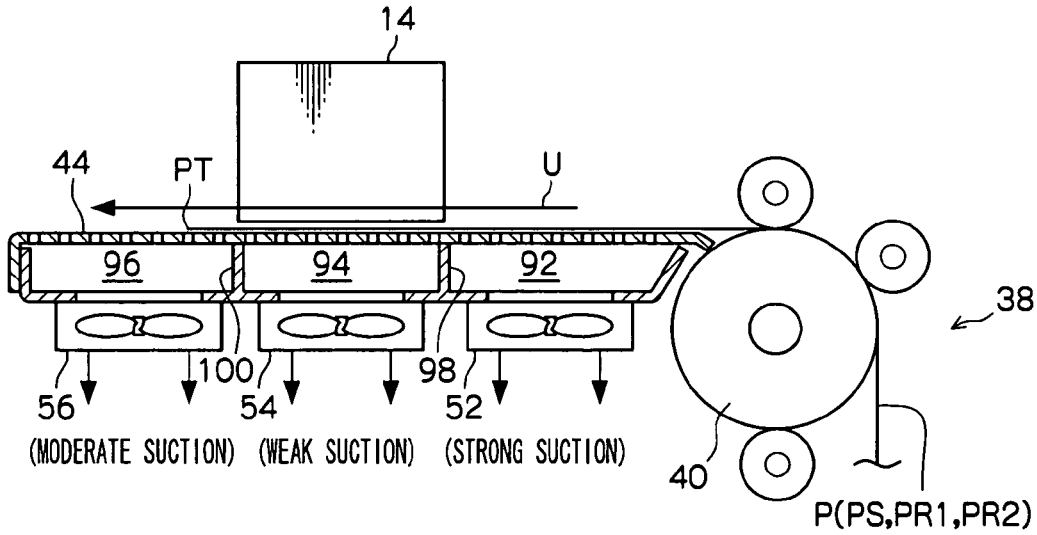

Next, a third exemplary embodiment will be described. As shown in FIG. 5A and FIG. 5B, an image forming apparatus pertaining to the present exemplary embodiment has the same configuration as that of the image forming apparatus 10 pertaining to the first exemplary embodiment except that the image forming apparatus here is equipped with an air chamber forming member 90 instead of the air chamber forming member 50. On the air chamber forming member 90, partition wall portions 98 and 100 are disposed so as to form three air chambers 92, 94 and 96 from the upstream side in the conveyance direction U to the downstream side between the air chamber forming member 90 and the conveyance path forming member 46. Additionally, the suction fans 52, 54 and 56 are disposed so as to respectively suck the air chambers 92, 94 and 96 with negative pressure. Consequently, the suction fan 52 performs strong suction (suction whose flow rate is high), the suction fan 54 performs weak suction (suction whose flow rate is low), and the suction fan 56 performs moderate suction (suction whose flow rate is moderate), substantially independently for one another.

According to the present exemplary embodiment, the effects obtained in the first exemplary embodiment can be exhibited even more excellently.

Figure 6:
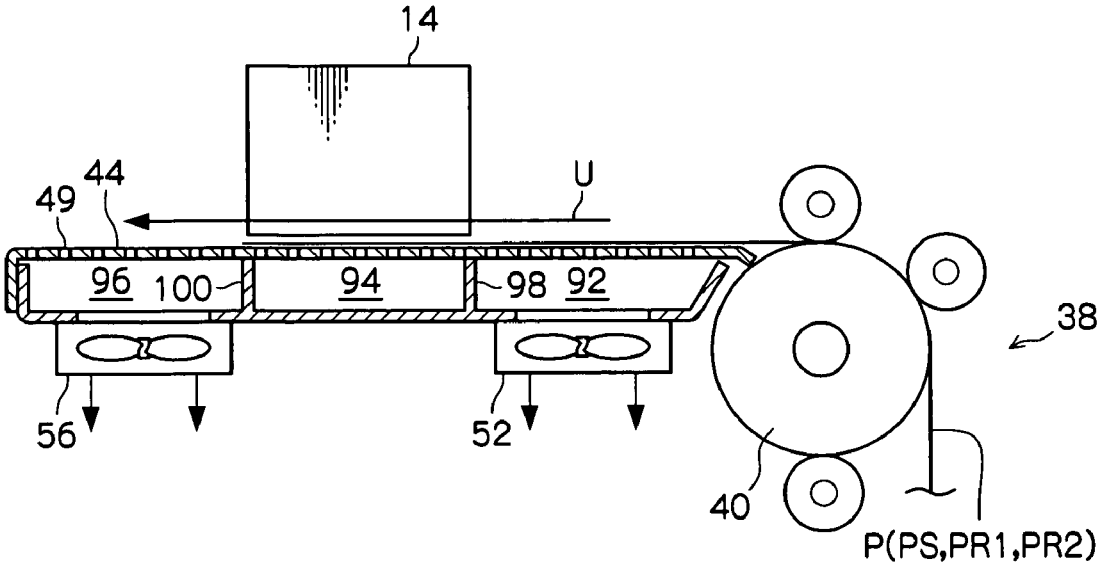
FIG. 6 is a side sectional view showing a modification of a suction conveyance unit of the image forming apparatus of the third exemplary embodiment.

As shown in FIG. 6, the image forming apparatus pertaining to the third exemplary embodiment may also be configured so as to not suck the air chamber 94 immediately under the inkjet recording head 14. Thus, the image forming apparatus can perform negative pressure suction that less disrupts the airflow immediately under the inkjet recording head 14.

Figure 7A:
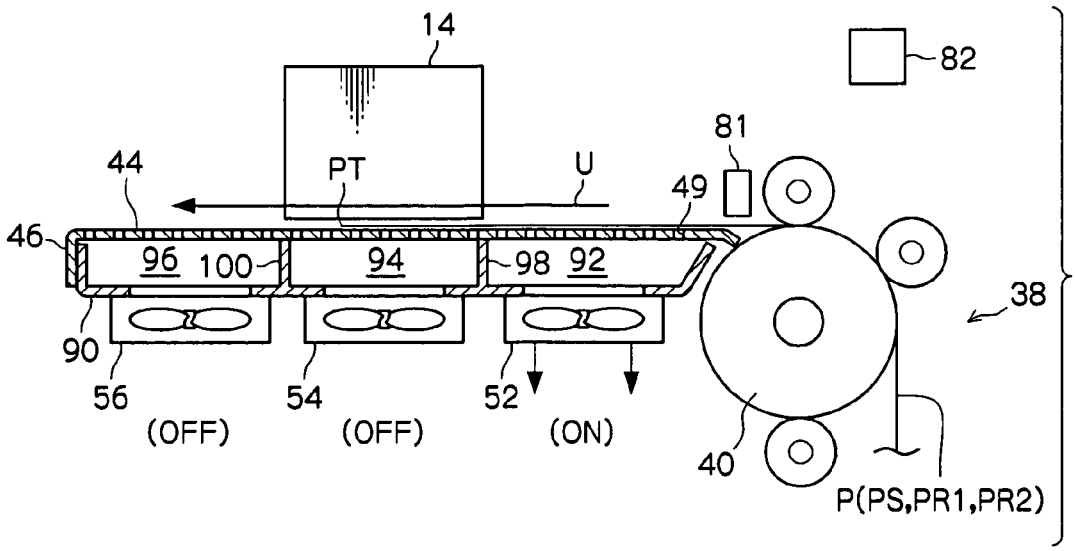
FIG. 7A is a side sectional view showing a state before a leading edge of the recording paper finishes passing directly under an inkjet recording head in the image forming apparatus pertaining to the third exemplary embodiment.
Figure 7B:
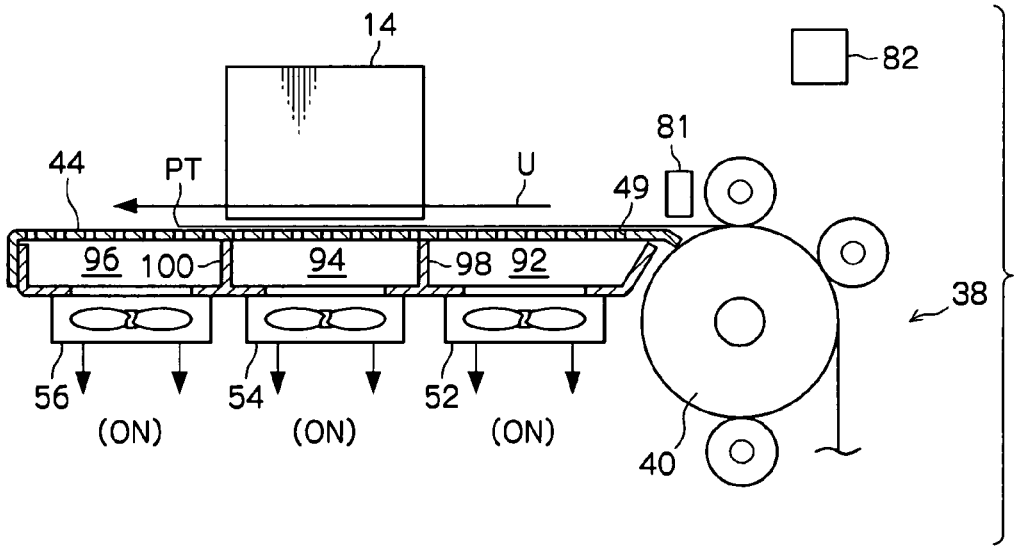
FIG. 7B is a side sectional view showing a state after the leading edge of the recording paper has finished passing directly under the inkjet recording head in the image forming apparatus pertaining to the third exemplary embodiment.

Further, as shown in FIG. 7A and FIG. 7B, the image forming apparatus pertaining to the third exemplary embodiment may also be equipped with the sensor 81 and the control unit 82 described in the second exemplary embodiment so as to control the suction force of the suction fans 52, 54 and 56. Thus, the image forming apparatus can detect the position of the leading edge PT of the recording paper P with the sensor 81 and perform control so as to not perform negative pressure suction at an area under the inkjet recording head 14 until the leading edge PT of the recording paper P passes immediately under (directly under) the inkjet recording head 14. That is, so as not to perform negative pressure suction resulting from the suction fans 54 and 56 until the leading edge PT of the recording paper P passes immediately under the inkjet recording head 14. Consequently, the image forming apparatus can perform negative pressure suction that less disrupts the airflow immediately under the inkjet recording head 14 and can form a more excellent image.

Fourth Exemplary Embodiment

Next, a fourth exemplary embodiment will be described. As shown in FIG. 8, an image forming apparatus pertaining to the present exemplary embodiment is equipped with a shutter 110 that is configured to be capable of reciprocally moving along the conveyance direction U on the bottom side of the conveyance path forming member 46. Additionally, the distribution of the suction force on the conveyance path 44 can be changed by the moving position of the shutter 110.

The conveyance direction length of the shutter 110 is configured to be shorter than the conveyed sheet recording paper PS. Further, the arranged positions of the open portions 49 formed in the conveyance path 44 are adjusted such that a region where the negative pressure suction is performed at the conveyance path 44 becomes further inside than both width direction edges of the recording paper PS (both edges of the recording paper PS in the direction orthogonal to the conveyance direction).

Further, one suction fan 112 is disposed instead of the three suction fans 52, 54 and 56. An air chamber forming member 120 that forms one air chamber 114 is disposed instead of the air chamber forming member 50 on the bottom side of the conveyance path 44. One opening 118 that allows the suction fan 112 and the air chamber 114 to be communicated with each other is formed in the air chamber forming member 120.

The movement of the shutter 110 in the vicinity of the inkjet recording head 14 is controlled by the control unit 82 (not shown). The control unit 82 causes the shutter 110 to move synchronously with the passage of the leading edge PT and a trailing edge PB of the recording paper P to open and close the open portions 49.

Figure 8A:
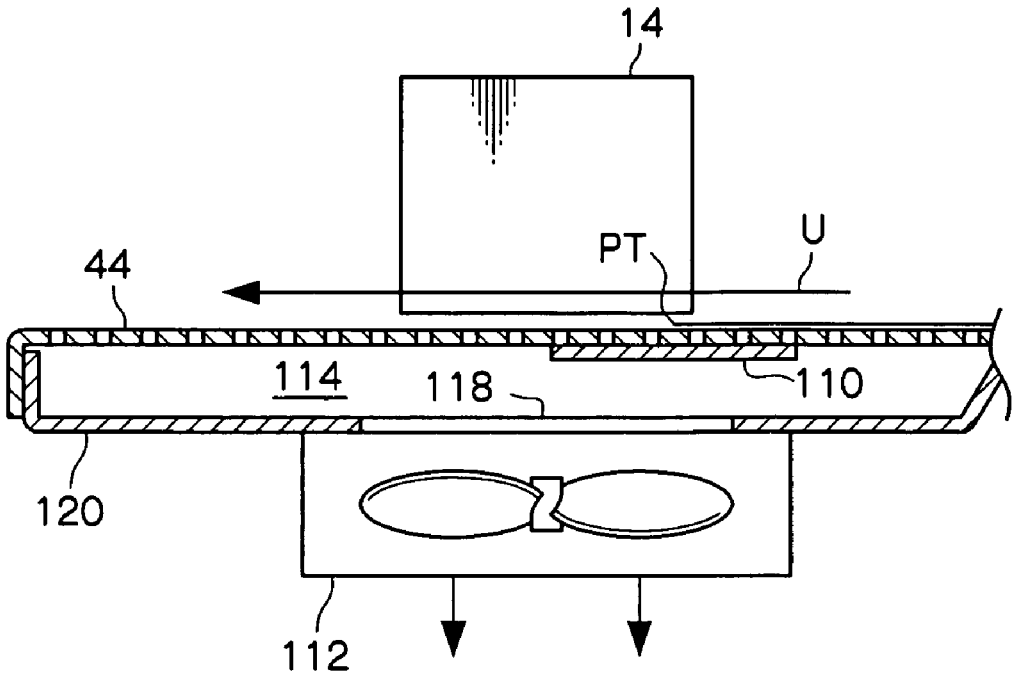
FIG. 8A is a side sectional view showing a state where a shutter is positioned directly under the conveyance direction leading edge of the recording paper which has been conveyed under the inkjet recording head in an image forming apparatus pertaining to a fourth exemplary embodiment.
Figure 8B:
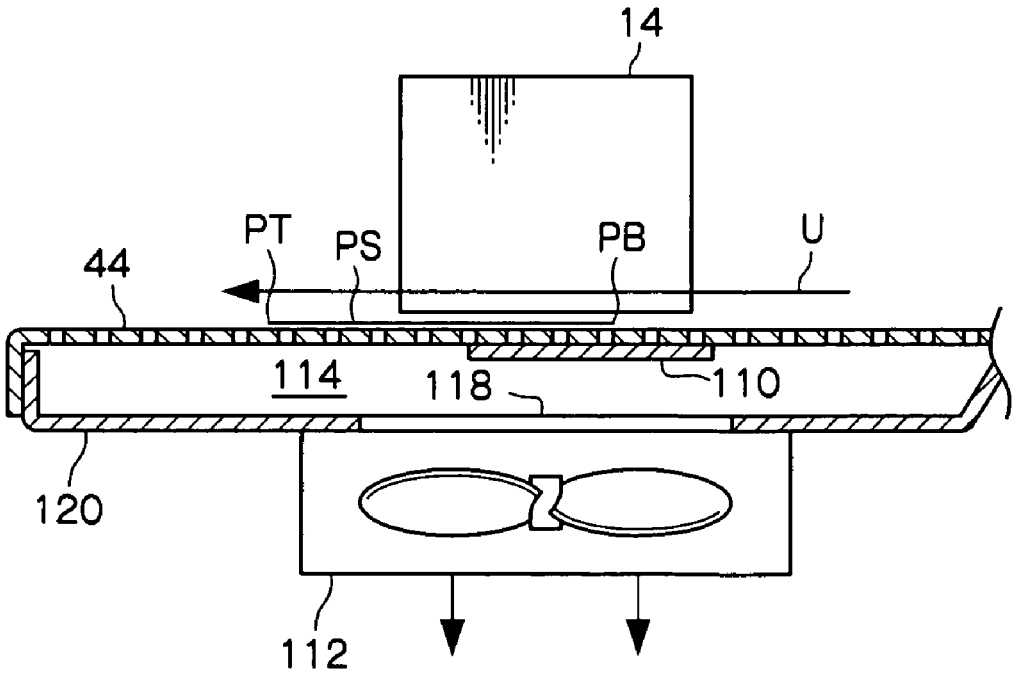
FIG. 8B is a side sectional view showing a state where the shutter is positioned directly under a conveyance direction trailing edge of the recording paper which has been conveyed under the inkjet recording head in the image forming apparatus pertaining to the fourth exemplary embodiment.

In the present exemplary embodiment, when the image forming apparatus conveys the sheet recording paper PS as the recording paper P, as shown in FIG. 8A, the position of the shutter 110 is controlled such that the shutter 110 blocks off a spot directly beneath an area which surrounds the leading edge PT of the recording paper PS when the leading edge PT passes directly under the inkjet recording head 14. Additionally, as shown in FIG. 8B, the position of the shutter 110 is controlled such that the shutter 110 blocks off a spot directly beneath an area surrounding the trailing edge PB of the recording paper PS when the trailing edge PB passes directly under the inkjet recording head 14.

Thus, the image forming apparatus can perform negative pressure suction reliably without disrupting the airflow in the areas around the leading edge PT and the trailing edge PB of the recording paper PS directly under the inkjet recording head 14. This is particularly effective when forming an image as far as the leading edge of the recording paper PS (e.g., when forming an image in a marginless photo print). Further, the number of suction fans that are installed can also be reduced.

When the image forming apparatus conveys and forms an image on the elongate recording paper PR1 and PR2 as the recording paper P, it suffices for the position of the shutter 110 to be controlled such that the shutter 110 blocks off a spot directly under an area surrounding the leading edge PT when the leading edge PT passes directly under the inkjet recording head 14.

Fifth Exemplary Embodiment

Figure 9:
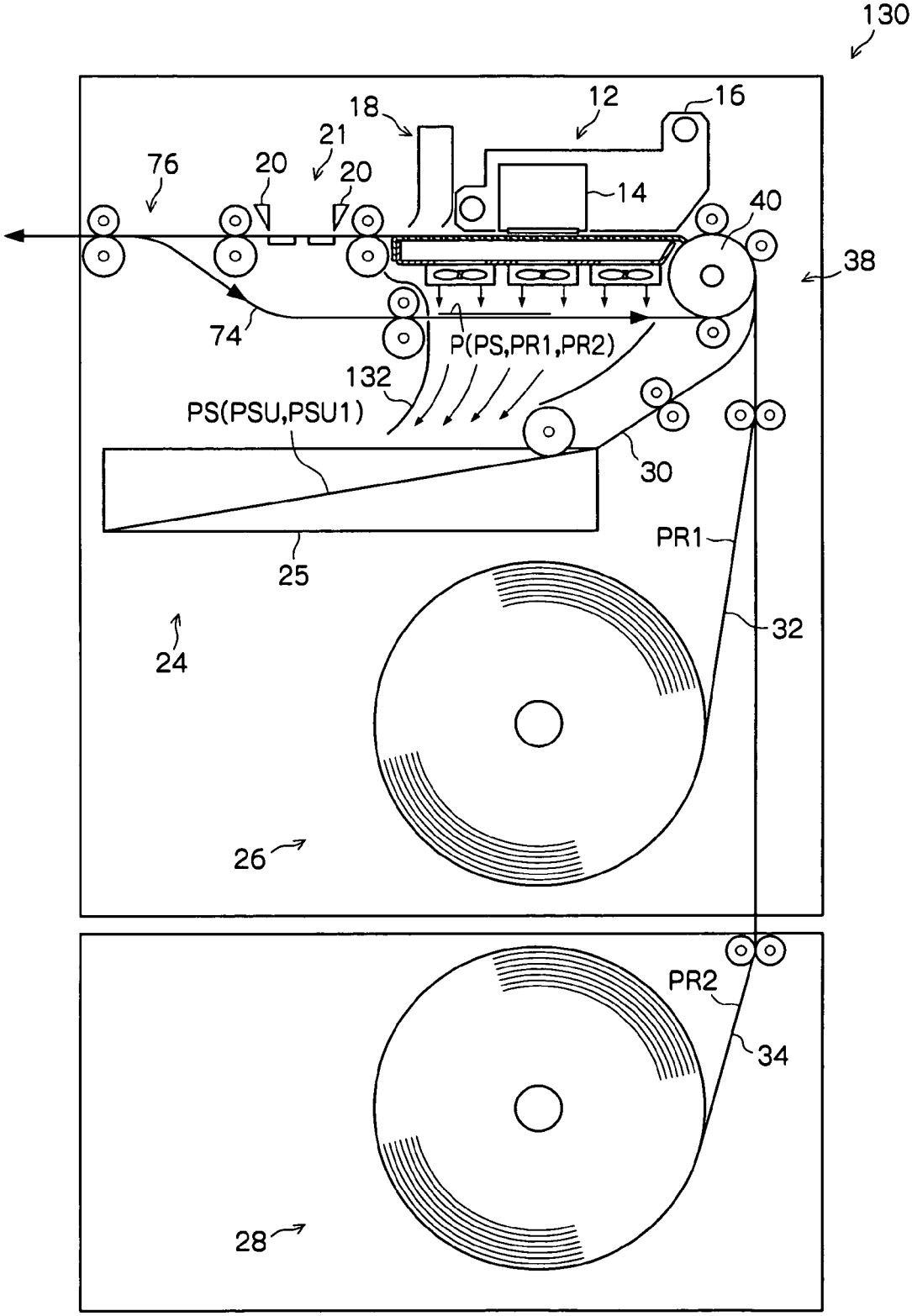
FIG. 9 is a side sectional view showing the configuration of an image forming apparatus pertaining to a fifth exemplary embodiment.

Next, a fifth exemplary embodiment will be described. As shown in FIG. 9, an image forming apparatus 130 pertaining to the present exemplary embodiment has the same configuration as that of the image forming apparatus 10 pertaining to the first exemplary embodiment and is further equipped with a duct 132 that is disposed so as to cause the warm air that has been blown from the dryer 18 toward the recording paper immediately after exiting the formation unit 12 to mix with the air that has been expelled from the switchback conveyance path 74 and blow the mixed air onto the top surface side of the sheet recording paper PS stored in the paper supply cassette 25.

Consequently, in an uppermost sheet PSU of recording paper PS in the paper supply cassette 25, the rate of moisture absorption becomes lower at one surface, which is the top surface side, in comparison to the bottom surface side, and the temperature becomes higher at the upper surface, in comparison to the bottom surface side, so that it is easy for the recording paper to bend such that its center portion becomes concave.

Thus, when the recording paper PSU is fed from the paper supply cassette 25 to the decurling conveyance unit 38 and is fed from the sub-scanning roller 40 to the suction conveyance unit 42, the top surface side of the recording paper PSU is the side facing the conveyance path 44, and the recording paper PSU is fed in a state where it is sufficiently bent to be separate from the surface of the conveyance path 44.

Further, even when the temperature of the air that is blown from the dryer 18 is at room temperature, preferable conditioning effect is obtained however, it is possible to obtain an excellent conditioning effect by setting the temperature of the blown air from the dryer 18 to around 70° C.

In this manner, in the present exemplary embodiment, the image forming apparatus conditions the one surface of the recording paper PSU in the paper supply cassette 25 utilizing the warm air that has been blown from the dryer 18 and the air that has been sucked by negative pressure. Consequently, the conditioning mechanism can become a simple configuration, the image forming apparatus can efficiently condition the recording paper PSU in a shorter period, and an energy-saving effect is obtained.

Further, even if the distribution of the suction force in the first exemplary embodiment is not formed, the image forming apparatus can sufficiently prevent the leading edge of the recording paper PSU from rising from the conveyance path 44 and can adhere by suction and convey the recording paper PSU. Further, even if the effect of decurling by the decurling conveyance unit 38 is not large, the image forming apparatus can sufficiently prevent the leading edge of the recording paper PSU from rising from the conveyance path 44 and can adhere by suction and convey the recording paper PSU, so that design flexibility for the decurling conveyance unit 38 may become wider.

Further, by setting the temperature of the air that is blown from the dryer 18 to around 70° C., drying can be promoted by conveyance on the switchback conveyance path 74, the temperature of the recording paper can be raised, and the effect of decurling of the recording paper by the decurling conveyance unit 38 can be sufficiently obtained.

When the one surface of the recording paper PSU becomes sufficiently concave by such conditioning, a mechanism that does not have a decurling function but simply conveys the recording paper PSU to the conveyance path 44 may be disposed instead of the decurling conveyance unit 38. Thus, the apparatus can be made compact.

Further, in the present exemplary embodiment, the duct 132 causes the warm air that has been blown from the dryer 18 toward the recording paper immediately after the recording paper exits the formation unit 12 to mix with the air that has been expelled from the switchback conveyance path 74, and applies the mixed air onto the top surface side of the recording paper PSU in the paper supply cassette 25, but the duct 132 may also be configured to directly apply the warm air that has been blown from the dryer 18 to the top surface side of the recording paper PSU of the paper supply cassette 25. Thus, the temperature of the top surface side of the recording paper PSU in the paper supply cassette 25 is raised even more, drying of the recording paper PSU in the paper supply cassette 25 is promoted, and it becomes even easier for the recording paper PSU in the paper supply cassette 25 to deform into a concave shape (concave as seen from the switchback conveyance path 74).

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a formation unit that forms an image on a first surface of a recording medium by inkjetting;

a suction conveyance unit that conveys the recording medium to the formation unit while suctioning the recording medium onto a guide surface which is a conveyance path;

a switchback conveyance unit that inverts the recording medium on whose first surface an image has been formed by the formation unit to allow a second surface of the recording medium to be used as an image formation surface, and conveys the recording medium to the suction conveyance unit; and a conditioning unit that conditions the first surface of the recording medium, wherein the conditioning unit controls a rate of moisture absorption of a surface of the recording medium and causes the recording medium that is fed to the suction conveyance unit via the switchback conveyance unit to bend such that the center portion of the recording medium separates from the guide surface of the suction conveyance unit.

2. The image forming apparatus according to claim 1, further comprising a blowing unit that blows air onto and dries a surface of the recording medium on which an image has been formed by the formation unit, wherein the conditioning unit conditions the first surface of the recording medium by directing the air that is blown from the blowing unit onto the first surface of the recording medium while the recording medium is being conveyed by the switchback conveyance unit.

3. The image forming apparatus according to claim 1, wherein a suction unit that performs negative pressure suction from an underside of the conveyance path so as to adhere the recording medium by suction onto the conveyance path is disposed in the suction conveyance unit, and the conditioning unit conditions the first surface of the recording medium by directing air that has been expelled from the suction unit onto the first surface of the recording medium while the recording medium is being conveyed by the switchback conveyance unit.

4. The image forming apparatus according to claim 3, further comprising a blowing unit that blows air onto and dries a surface of the recording medium on which an image has been formed by the formation unit, wherein the conditioning unit causes the air that is blown from the blowing unit to mix with the air that is expelled from the suction unit and blow onto the first surface of the recording medium while the recording medium is being conveyed by the switchback conveyance unit.

5. The image forming apparatus according to claim 3, further comprising a sub-scanning roller that conveys the recording medium from the switchback conveyance unit to the conveyance path, wherein the sub-scanning roller includes a roller surface that contacts the first surface of the recording medium.

* * * * *